US006679281B1

(12) United States Patent
Thiry et al.

(10) Patent No.: US 6,679,281 B1
(45) Date of Patent: Jan. 20, 2004

(54) SWITCHING DEVICE FOR A MACHINE

(75) Inventors: Gerd Anton Thiry, Wadgassen (DE); Harald Bär, Püttlingen (DE); Martin Schaus, Friedrichsthal (DE)

(73) Assignee: Hydac Fluidtechnik GmbH, Sulzbach/Saar (DE)

( * ) Notice: Subject to any disclaimer, the term of this patent is extended or adjusted under 35 U.S.C. 154(b) by 0 days.

(21) Appl. No.: 10/019,084

(22) PCT Filed: Jun. 27, 2000

(86) PCT No.: PCT/EP00/05976

§ 371 (c)(1),
(2), (4) Date: Dec. 26, 2001

(87) PCT Pub. No.: WO01/02735

PCT Pub. Date: Jan. 11, 2001

(30) Foreign Application Priority Data

Jul. 1, 1999 (DE) ..... 199 30 101

(51) Int. Cl.[7] ..... F15B 13/08; F15B 1/027
(52) U.S. Cl. ..... 137/118.06; 60/418; 137/596
(58) Field of Search ..... 60/418; 137/118.06, 137/596

(56) References Cited

U.S. PATENT DOCUMENTS 4,332,270 A * 6/1982 Budecker ..... 137/118.06
5,135,020 A * 8/1992 Rausch ..... 137/115.18
6,000,219 A * 12/1999 Mies ..... 60/418

FOREIGN PATENT DOCUMENTS

| | | |
|---|---|---|
| DE | 3011518 | 10/1981 |
| DE | 3034467 | 5/1982 |
| DE | 3119802 | 12/1982 |
| DE | 4004931 | 8/1991 |
| GB | 2306926 | 5/1997 |

* cited by examiner

*Primary Examiner*—Gerald A. Michalsky
(74) *Attorney, Agent, or Firm*—Roylance, Abrams, Berdo & Goodman, LLP

(57) ABSTRACT

A switching device for a machine, especially a digger, has at least one supply connection and one useful connection in addition to at least one hydraulic accumulator. An on-off valve is arranged between the supply connection and the useful connection, and separates the supply connection at least partially from the useful connection in one of its switching positions, in addition to ensuring that the hydraulic accumulator is charged on the fluid side via the supply connection. In another switching position, the supply connection is connected to the useful connection. A substantial improvement relative to conventional switching devices is attained by being able to guarantee an emergency function before the machine is used to perform work.

23 Claims, 2 Drawing Sheets

SWITCHING DEVICE FOR A MACHINE

FIELD OF THE INVENTION

The present invention relates to an actuator for a machine, especially an excavator, with at least one supply port and one working port and with at least one hydraulic accumulator.

BACKGROUND OF THE INVENTION

Actuators for machines are readily available on the market in a plurality of embodiments. The supply port is used to connect a pump unit, for example, in the form of a hydraulic pump, to supply the hydraulic circuit connected to the working port with pressurized hydraulic fluid. These hydraulic circuits are generally divided into a high pressure part and a low pressure part. The actuating means for the machine is connected to the low pressure part through which low pressure part the operator, for example, the excavator operator, actuates the equipment of the high pressure circuit for working processes. A hydraulic accumulator ensures hydraulic supply for a certain interval in case of a supply failure within the hydraulic circuit to prevent the working equipment, for example, in the form of a drag, from falling down in the raised state or the like. This falling would constitute a safety risk.

In the known or conventional actuators, the hydraulic accumulator must first be charged to produce this safety function. To ensure emergency supply, the machines they cannot immediately begin working. Rather, a defined actuation function must first be carried out by the excavator operator, for example, by lifting the drag, to guarantee that the accumulator in this process is charged for a later emergency function. Generally, this working process is described in the operating instructions of the machine and must be carried out with the corresponding accuracy.

A generic actuator for a machine is disclosed DE-A-30 34 467, and monitors a connection between a supply port and a storage tank (tank T) on one side and a hydraulic accumulator on the other side. A relay valve has a valve element impactable by the pressure in the hydraulic accumulator, and a switching valve controllable by the relay valve. The valve element of the relay valve optionally connects a control line leading to the switching valve with the supply port or the storage tank (tank T). The known actuator promotes reliable on and off switching of the hydraulic accumulator. The valve element of the relay valve does not assume a control function, i.e., the connection between the hydraulic pump and the hydraulic accumulator is either completely open or completely closed. During reversing from pump pressure to accumulator pressure and vice versa, the valve element completes a rapid switching motion and hence acts like a flip-flop connection. This arrangement results in reliable on and off switching of the hydraulic pump and the storage tank (tank T) and/or the respective consumer. Realization of emergency supply within the meaning outlined above is, however, not possible with the disclosed actuator, which merely ensures a monitoring function.

SUMMARY OF THE INVENTION

Objects of the present invention is to provide improved actuators to ensure an emergency function before the machine begins to perform work.

The pressure prevailing in a secondary line and corresponding essentially to the fluid-side accumulator pressure is used for switching the switching valve. Because of a pressure reducing valve being situated between the switching valve and the secondary line, the pressure reducing valve separates within a hydraulic circuit a low pressure part from a high pressure part. Both parts are supplied via the supply port. The high pressure circuit is separated from the supply port and moreover from the supply circuit. The hydraulic accumulator is charged via the supply port when the machine is turned on, before the machine begins to perform work. Thus, immediately after the drive assembly and moreover the hydraulic pump are turned on, emergency supply pressure is available. The operator can immediately begin working without needing first to consider the emergency function. This arrangement enhances safety and facilitates operation of the machine, and therefore, guarantees immediate operating availability. Separation of the supply port from the working port can be complete in the sense of fluid blocking. Preferably, there is only partial separation, for example, by means of a choke which can still ensure partial supply of the high pressure circuit for certain working functions, at the same time emergency supply being ensured.

Furthermore, supply of the high pressure part as well as the low pressure part can be ensured by only one supply port. In contrast to optional electric control of the switching valve by electric switching magnet, the actuation of the switching valve is pressure controlled and hence functionally reliable.

In another preferred embodiment of the actuator of the present invention, between the switching valve and the secondary line, a pressure reducing valve is within a hydraulic circuit to separate the low pressure part from the high pressure part. The two parts are supplied via the a supply port. In this way, supply of the high pressure part and the low pressure part can be guaranteed via only one supply port.

In another preferred embodiment of the actuator of the present invention, between the secondary line and the hydraulic accumulator, a return valve opens in the direction of the hydraulic accumulator ensuring therethrough reliable separation in the case of supply failure, especially of the pump flow, from the low pressure part to the high pressure part. Preferably, the hydraulic accumulator with its fluid side is connected to the low pressure part which supplies the control unit, especially with a joystick, via another valve, especially a sliding valve. The control unit, as part of the actuating means of the machine, is thus supplied via the fluid side of the hydraulic accumulator and can influence the low pressure part with the equipment connected to it via corresponding control units.

In another preferred embodiment of the actuator of the present invention, the secondary line discharges into another working port. On the low pressure side, a third working port can be cut off via a third valve, especially in the form of another sliding valve. In this way, within the actuator still other working ports are available for actuating processes on the machine. Preferably, the sliding valves, the pressure limitation valves and the pressure reducing valves are connected to a tank port having essentially the ambient pressure.

In one especially preferred embodiment of the actuator of the present invention, the hydraulic accumulator is a membrane accumulator. The hydraulic accumulator and all the valves are made as screw-in parts, especially in the form of screw-in cartridges. Preferably, the actuator is made in a block design, the actuator block on the outer periphery side being provided with the supply port, the working ports and the tank port and with connection points for accommodating the screw-in parts. Within the actuator block, the connecting lines preferably extend between the ports and the connection points. In this way, a modular structure of the actuator concept is accomplished, with a compact structure requiring little installation space within the machine. Furthermore, when one component fails, it can be easily and economically replaced by a replacement part. The reversing valve and the return valve are preferably made as kits.

Preferably, the low pressure part has a working pressure of at least 20 bar, and the high pressure part has a working pressure of at least 200 bar.

Other objects, advantages and salient features of the present invention will become apparent form the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
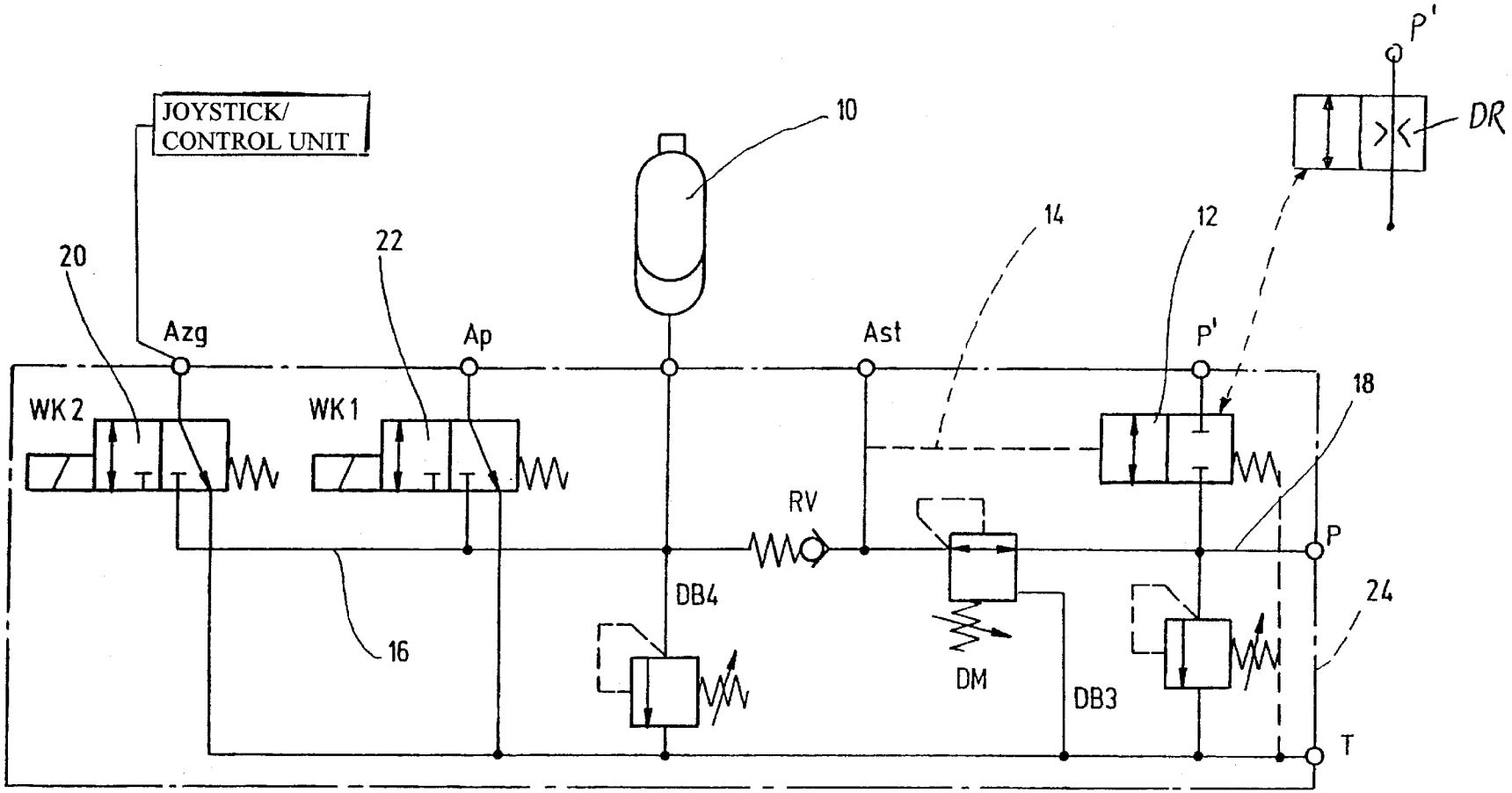
FIG. 1 is a schematic hydraulic diagram of an actuator according to an embodiment of the present invention.

The actuator, as shown in the drawings, is designed for a machine, especially an excavator, and has a supply port P and a working port P'. Furthermore, a hydraulic accumulator 10 is a membrane accumulator. As FIG. 1 further shows, between the supply port P and the working port P', a switching valve 12 is used as a reversing valve. In the first operating position shown in FIG. 1, switching valve 12 separates the supply port P from the working port P', or chokes it and guarantees fluid-side charging of the hydraulic accumulator 10 via the supply port P. The gas side of the hydraulic accumulator 10 is provided with a working gas, especially in the form of nitrogen, with a pressure which can be stipulated. In the other or second operating position of the switching valve 12, the supply port P would be connected to the working port P', routing fluid.

In its initial position shown in FIG. 1, the switching valve 12 at least partially separates the supply port P from the working port P'. The switching pressure prevails in a secondary line 14, corresponds essentially to the fluid-side pressure of the hydraulic accumulator 10, and is used to switch the switching valve 12 into its supply position which links the supply port P to the working port P'.

Between the switching valve 12 and the secondary line 14 a pressure reducing valve DM separates the low pressure part 16 from the high pressure part 18 within the hydraulic circuit. The two parts are supplied via the supply port P. Between the secondary line 14 and the hydraulic accumulator 10, a return valve RV opens in the direction of the hydraulic accumulator 10. Furthermore, the hydraulic accumulator 10 has its fluid side connected to the low pressure part 16 which via another valve 20, especially in the form of a sliding valve, supplies a control unit (not shown) for actuating the equipment, especially with a joystick (not shown) for operation by an operator. The pertinent port is labeled Azg in FIG. 1.

Another or second working port Ast discharges into the secondary line 14. On the low pressure side 16, a third working port Ap can be blocked via a third valve 22, especially in the form of another sliding valve. The two sliding valves 20 and 22 are spring-loaded or biased toward their base positions shown in FIG. 1, and can be electrically actuated via switching magnets WK1, WK2. Due to the other two working ports Ap and Ast, on the low pressure side other units of the machine can be hydraulically connected to the actuator. Furthermore, the high pressure part 18 is safeguarded via a pressure limitation valve DB3. The low pressure part 16 is protected via the pressure limitation valve DB4. The two sliding valves 20, 22, the two pressure limitation valves DB3 and DB4 and the pressure reducing valve DM are connected to carry fluid to a tank port T having essentially the ambient pressure.

Figure 2:
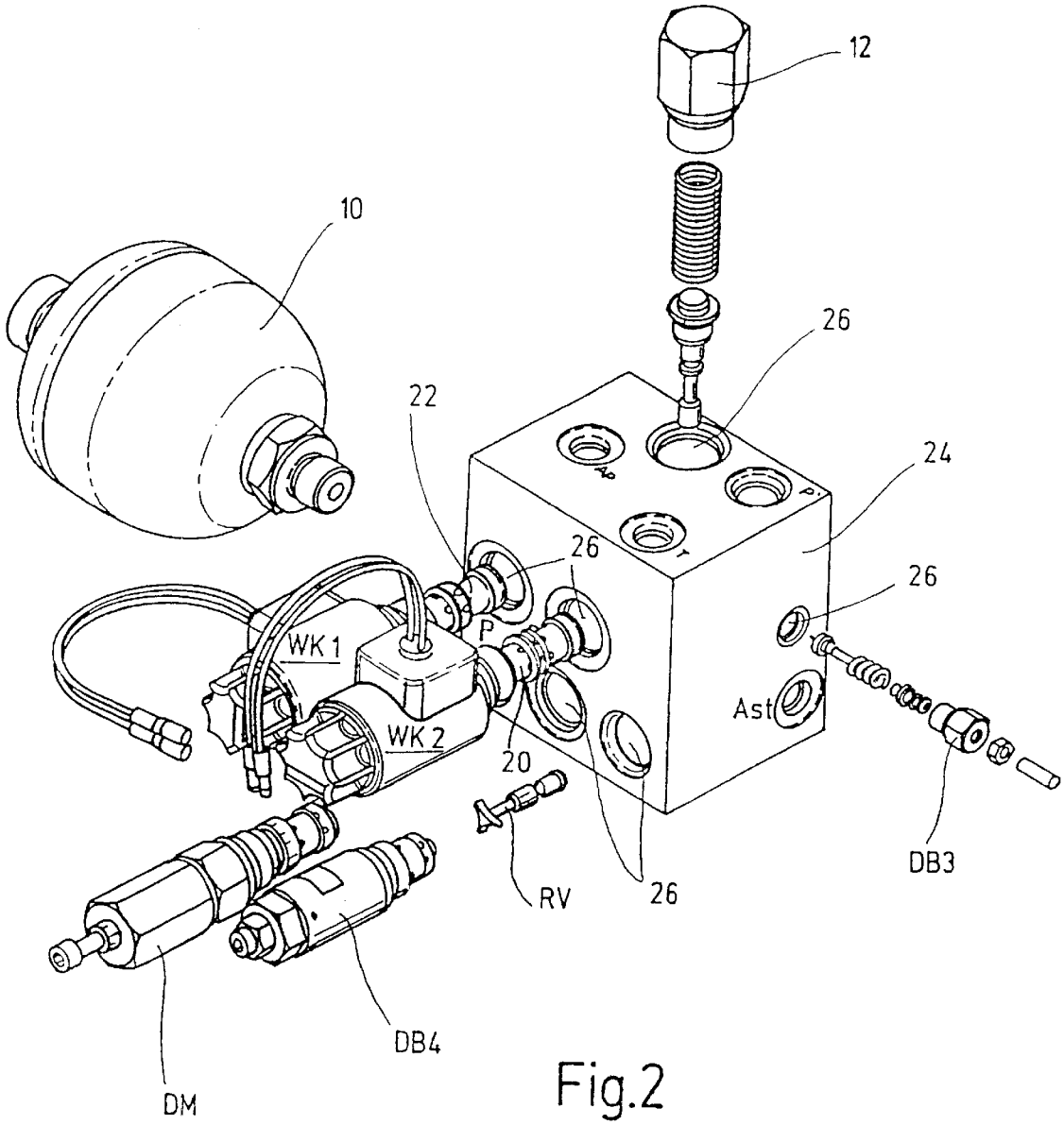
FIG. 2 is an exploded perspective view of the actuator of FIG. 1.

As shown especially by FIG. 2, the hydraulic accumulator 10 is a membrane accumulator. The hydraulic accumulator 10 and all valves 12, 20, 22, DM, RV, DB3 and DB4 are made as screw-in parts, especially in the form of screw-in cartridges. As FIG. 2 furthermore shows, the actuator is made in a block design, the actuator block 24 being in the form of a cube or cuboid. On the outer peripheral side, actuator block 24 has the supply port P, the working ports P', Ast and Ap and the tank port T. Furthermore, it has a port Azg and the corresponding connection points 26 for accommodating the screw-in parts. Within the actuator block 24 (not detailed), the corresponding connecting lines establish the connections between the indicated ports and the connection points 26.

This actuator is now described with respect to its function. When the machine, especially in the form of an excavator, is turned on, the drive unit, especially in the form of a diesel engine, runs and drives a hydraulic pump (not shown). The hydraulic pump delivers to the supply port P a working fluid pressure, for example at a level of 230 bar. When the machine starts, the switching valve 12 is in its interlocked or choked operating position shown in FIG. 1. Also, the fluid pressure of the high pressure part 18 is brought via the pressure reducing valve DM to the working pressure of the low pressure part 16, for example by setting the pressure reducing valve to a set pressure of 45 bar. The return valve RV is opened against its spring force, and the supply port P supplies the hydraulic accumulator 10 on its fluid side with reduced pressure.

The accumulator is now filled or loaded on the fluid side against the gas working pressure until the pressure in the secondary line 14 corresponds roughly to the desired working pressure in the hydraulic accumulator 10, for example, 35 bar at a delivery volume of 6.6 l/min. If pressure equilibrium is established in the low pressure part 16 between the fluid side of the hydraulic accumulator 10 and the prevailing pressure in the secondary line 14, including the closing force of the reset springs of the return valve RV, the switching valve 12 is moved into its fluid-carrying operating position. In the operating position, the supply port P is connected to the working port P' so that the working pressure of the high pressure part 18 of the actuator can then prevail on or be conveyed to the equipment of the machine, for example, in the form of hydraulic cylinders. If the sliding valves 20, 22 are switched via electromagnets WK2 and WK1, the pressure in the low pressure part 16 prevails on the ports Azg and Ap which are otherwise connected to the tank side 16 to carry fluid. Via the ports Azg and Ap, the control unit for the machine can be supplied with low pressure, as can another hydraulic consumer of the entire hydraulic circuit (not shown).

If malfunctions occur, emergency function is ensured via the hydraulic accumulator 10 which then guarantees emergency supply via the respective port Azg and/or Ap. The return valve is blocked relative to the high pressure part 18. In this way, for example, a raised drag upon failure of the hydraulic supply can be kept in its position or lowered in a defined manner. There is another working port for another hydraulic consumer on the low pressure side via the working port Ast. With the actuator of the present invention, it is therefore ensured that, before the actual start of operation with the machine, the emergency accumulator in the form of a hydraulic accumulator 10 is filled with a pressurized fluid reserve which can then later guarantee emergency supply in any case.

For partial separation of the fluid supply for the high pressure circuit, a choke DR can be provided so that the switching valve 12, as shown in FIG. 1, can be replaced by a switching valve with a choke, as shown. In this way, emergency supply can be ensured via a hydraulic accumulator 10 and at the same time at least one working function within the high pressure circuit can be achieved.

While one embodiment has been chosen to illustrate the invention, it will be understood by those skilled in the art that various changes and modifications can be made therein without departing from the scope of the invention as defined in the appended claims.

What is claimed is:

1. An actuator for a machine, comprising:

supply port;

hydraulic circuit with a high pressure part and a low pressure part in fluid communication with said supply port to supply pressure to said high and low pressure parts;

a first working port;

at least one hydraulic accumulator with a fluid side;

a switching valve between said supply port and said first working port at least partially separating said supply port and said first working port in a first operating position thereof to ensure connection of said supply port and said accumulator to charge said accumulator and connecting said supply port and said first working port in a second operating position of said switching valve, said switching valve being initially in said first operating position and having a secondary line connected thereto and connected to operating pressure from said supply port to move said switching valve form said first operating position to said second operating position, said operating pressure in said secondary line corresponding essentially to pressure at said fluid side of said accumulator;

a pressure reducing valve between said switching valve and said secondary line and separating said low pressure part from said high pressure part of said hydraulic circuit; and a return valve between said secondary line and said accumulator, and opening in a direction of said accumulator.

2. An actuator according to claim 1 wherein said actuator is an excavator.

3. An actuator according to claim 1 wherein said fluid side of said hydraulic accumulator is connected to said low pressure part; and a control unit is connected to said fluid side through another control valve.

4. An actuator according to claim 3 wherein said control unit comprises a joystick.

5. An actuator according to claim 3 wherein said other control valve is a sliding valve.

6. An actuator according to claim 1 wherein said secondary line discharges into a second working port; and said low pressure part has a third working port connected to and controlled by a further control valve.

7. An actuator according to claim 6 wherein said further control valve is a sliding valve.

8. An actuator according to claim 6 wherein pressure limitation valves are connected to and safeguard said high pressure part and said low pressure part.

9. An actuator according to claim 8 wherein said fluid side of said hydraulic accumulator is connected to said low pressure part;

a control unit is connected to said fluid side through another control valve; and said other control valve, said further control valve, said pressure limitation valves and said pressure reducing valve are connected to a tank port.

10. An actuator according to claim 9 wherein said accumulator is a membrane accumulator; and said accumulator and said valves comprise screw-in parts.

11. An actuator according to claim 10 wherein said screw-in parts are screw-in cartridges.

12. An actuator according to claim 10 wherein an actuator block has a peripheral side providing said supply port, said working ports, said tank port and connection points to mate with said screw-in parts, with connecting lines extending within said actuator block between said working ports and said connection points.

13. An actuator for a machine, comprising:

a supply port;

a hydraulic circuit with a high pressure part and a low pressure part in fluid communication with said supply port to supply pressure to said high and low pressure parts;

a first working port;

at least one hydraulic accumulator with a fluid side;

a switching valve between said supply port and said first working port at least partially separating said supply port and said first working port in a first operating position thereof to ensure connection of said supply port and said accumulator to charge said accumulator and connecting said supply port and said first working port in a second operating position of said switching valve, said switching valve being initially in said first operating position and having a secondary line connected thereto and connected to operating pressure from said supply port to move said switching valve from said first operating position to said second operating position, said operating pressure in said secondary line corresponding essentially to pressure at said fluid side of said accumulator;

a pressure reducing valve between said switching valve and said secondary line and separating said low pressure part from said high pressure part of said hydraulic circuit;

a second working port into which said secondary line discharges; and a third working port in said low pressure part connected to and controlled by a further control valve.

14. An actuator according to claim 13 wherein said actuator is an excavator.

15. An actuator according to claim 13 wherein said fluid side of said hydraulic accumulator is connected to said low pressure part; and a control unit is connected to said fluid side through another control valve.

16. An actuator according to claim 15 wherein said control unit comprises a joystick.

17. An actuator according to claim 15 wherein said other control valve is a sliding valve.

18. An actuator according to claim 15 wherein pressure limitation valves are connected to and safeguard said high pressure part and said low pressure part.

19. An actuator according to claim 18 wherein said other control valve, said further control valve, said pressure limitation valves and said pressure reducing valve are connected to a tank port.

20. An actuator according to claim 19 wherein said accumulator is a membrane accumulator; and said accumulator and said valves comprise screw-in parts.

21. An actuator according to claim 20 wherein said screw-in parts are screw-in cartridges.

22. An actuator according to claim 20 wherein an actuator block has a peripheral side providing said supply port, said working ports, said tank port and connection points to mate with said screw-in parts, with connecting lines extending within said actuator block between said working ports and said connection points.

23. An actuator according to claim 13 wherein said further control valve is a sliding valve.

* * * * *